US005542261A

United States Patent [19]

Albertson et al.

[11] Patent Number: 5,542,261

[45] Date of Patent: Aug. 6, 1996

[54] REFRIGERANT EVAPORATOR OVER-PRESSURE RELIEF SYSTEM INCLUDING A FLUID CONTAINMENT VESSEL

[76] Inventors: Luther D. Albertson, 3834 Carver St., New Albany, Ind. 47150; Walter R. Key, 6362 Minlo Dr., Indianapolis, Ind. 46227; Mark B. Key, 526A Paradise Way West, Greenwood, Ind. 46143

[21] Appl. No.: 423,202

[22] Filed: Apr. 17, 1995

[51] Int. Cl.[6] ..... F25B 41/00

[52] U.S. Cl. ..... 62/174; 62/149

[58] Field of Search ..... 62/149, 174, 509, 62/503, 512, 298, 324.4, 504, 86

[56] References Cited

U.S. PATENT DOCUMENTS

| | | | |
|---|---|---|---|
| 3,191,396 | 6/1965 | Ruddock | 62/174 X |
| 3,827,249 | 8/1974 | Garland et al. | 62/174 |
| 4,546,616 | 10/1985 | Drucker | 62/509 X |
| 5,117,645 | 6/1992 | Bryant | 62/174 |
| 5,319,945 | 6/1994 | Barlett | 62/174 |
| 5,361,592 | 11/1994 | Lewis | 62/149 X |

*Primary Examiner*—Harry B. Tanner

*Attorney, Agent, or Firm*—Woodard, Emhardt, Naughton Moriarty & McNett

[57] ABSTRACT

The present invention relates to a fluid containment system for minimizing the loss of refrigerant fluid from a refrigerant evaporator. The mechanical refrigeration system includes an evaporator for absorbing energy from the cooling media. The evaporator includes a pressurized shell, which to comply with applicable safety codes requires a pressure relief system for relieving an over-pressure condition. A sealed over-pressure containment vessel is connected in fluid communication with the evaporator. The containment vessel receives liquid refrigerant from the evaporator in order to reduce the pressure in the evaporator, and the flow of refrigerant fluid from the evaporator to the containment vessel is controlled by a pressure differential therebetween. After the over-pressure condition in the evaporator has been corrected the liquid refrigerant in the containment vessel can be returned to the evaporator. The containment vessel while receiving liquid refrigerant from the evaporator allows for the reduction of pressure in the evaporator and acts to help prevent the discharge of refrigerant into the atmosphere.

28 Claims, 3 Drawing Sheets

REFRIGERANT EVAPORATOR OVER-PRESSURE RELIEF SYSTEM INCLUDING A FLUID CONTAINMENT VESSEL

BACKGROUND OF THE INVENTION

The present invention relates generally to the field of fluid containment systems for controlling over-pressure conditions in a refrigerant evaporator of a mechanical refrigeration system. More particularly, in the preferred embodiment the present invention relates to a low pressure centrifugal chiller having the refrigerant evaporator in fluid communication with a containment vessel for receiving refrigerant fluid from the over-pressure evaporator.

A low pressure centrifugal chiller is generally utilized in commercial and industrial refrigeration systems, such as for providing air conditioning in hotels, cooling fluid for a manufacturing process, and commercial food refrigeration systems. Low pressure centrifugal chillers typically use a chlorinated fluorocarbon (CFC) refrigerant in their operation. CFC refrigerants, many of which are sold by DuPont under the well known tradename FREON, have various boiling points, depending on the particular type of CFC refrigerant. Some typical types of CFC refrigerants are for example, R11, R113 and R123. FREON and its related family of compounds are well known and widely used as heat transfer media in mechanical refrigeration systems.

Mechanical refrigeration systems generally utilize the evaporation of liquid refrigerant into refrigerant vapor inside of the evaporator to absorb substantially large quantities of energy from a cooling fluid. The refrigerant vapor is then pumped to a refrigerant condenser where the latent heat of the pressurized vapor is removed, thereby condensing the vapor into a liquid. The above described cycle is repeated with the refrigerant liquid being vaporized in the evaporator and then subsequently condensed in the condenser.

The refrigerant evaporator generally contains a quantity of relatively low pressure refrigerant vapor. Under certain conditions the pressure within the evaporator can reach unacceptably high values. For example, in one type of cooling system, water is passed through the evaporator coils of a refrigeration system in order to be cooled, and the cooled water is then circulated through a water circulation system to other areas remote from the coils. In this cooling system the refrigeration system can be shut down while the water circulation system is left functioning. Therefore as the building or system warms the temperature of the circulating water-increases, thereby causing a temperature increase in the evaporator and vaporization of the refrigerant fluid within the evaporator, which raises the evaporator pressure.

Another type of temperature control system utilizes a common heat transfer fluid and circulation system to provide the heating and cooling for a structure. The system generally includes valves to divert the heat transfer fluid within the circulation system to either the refrigeration system or the boiler system. Valve misfunction or operator error can introduce hot heat transfer fluid from the heating system into the refrigeration system evaporator. The hot heat transfer fluid can cause rapid evaporation of the refrigerant within the evaporator, resulting in an evaporator over-pressure condition.

For many years it was an industry practice to include on the evaporator a safety relief valve to protect the equipment from an over-pressure condition; after the pressure in the evaporator exceeds a predetermined value the safety relief valve opens to release refrigerant gas into the atmosphere in order to lower the pressure buildup within the evaporator. Further, many mechanical refrigerant systems utilize a rupture disk that fragments or bursts into pieces at a predetermined pressure and allows the escape of refrigerant gas from the evaporator.

The release of refrigerant gas into the atmosphere while being an effective way to reduce evaporator pressure and save the equipment, unfortunately may contribute to pollution in the atmosphere. Most recently the United States and many other countries have agreed to halt the production of CFC refrigerants after 1995. Environmental concerns, though significant are not the only factor in favor of preventing the release of CFC refrigerant into the atmosphere. The refrigerant vented into the atmosphere is not recoverable and replacement refrigerant must be added to the system after the over-pressure condition is stabilized. In recent years the cost of CFC refrigerant has escalated drastically, having increased over tenfold for some refrigerant in the past years. Further, refrigerant vapor can displace the oxygen in an enclosed area and cause injury or death to persons or animals occupying the area. For these reasons it is desirable to ensure that no significant quantity of CFC refrigerant is vented into the atmosphere by the pressure relief system.

Many prior designers of mechanical refrigeration fluid systems have utilized a containment vessel to receive refrigerant fluid from an evaporator in order to reduce the ever-pressure condition in the evaporator. These prior fluid containment systems have utilized a valve, pump, or other auxiliary device to allow the transfer of refrigerant fluid from the evaporator to the containment vessel. A common limitation of the prior designs is the requirement of an auxiliary apparatus to facilitate the transfer of refrigerant fluid from the evaporator to the containment vessel. If the auxiliary apparatus fails to function, the evaporator will continue the over-pressure buildup which can result in the venting of refrigerant fluid into the atmosphere. Another limitation of the prior art systems is that these fluid containment systems only provides for the flow of refrigerant in one direction from the evaporator to the containment vessel, and not for a bi-directional flow of fluid. Therefore in the prior systems after the over-pressure condition has been stabilized it is necessary to perform additional functions to return the refrigerant fluid to the evaporator.

There remains a need for a fluid containment system for minimizing or preventing the venting of refrigerant gas from an over-pressure evaporator into the atmosphere. The present invention satisfies this need in a novel and unobvious way.

SUMMARY OF THE INVENTION

To address the unmet needs of the prior mechanical refrigeration systems, the present invention contemplates a system for minimizing or preventing the loss of refrigerant fluid. The apparatus comprises: a mechanical refrigeration system incorporating refrigerant fluid; an evaporator within the refrigeration system, the evaporator for receiving the fluid therein; and an over-pressure containment vessel in fluid communication to the bottom of the evaporator, the vessel for receiving fluid from the evaporator to reduce the pressure in the evaporator and the receipt of fluid from the evaporator being controlled by a pressure differential between the evaporator and the vessel during normal operation of the mechanical refrigeration system.

One object of the present invention is to provide an improved fluid containment system.

Related objects and advantages of the present invention will be apparent from the following description.

DESCRIPTION OF THE PREFERRED EMBODIMENT

Figure 1:
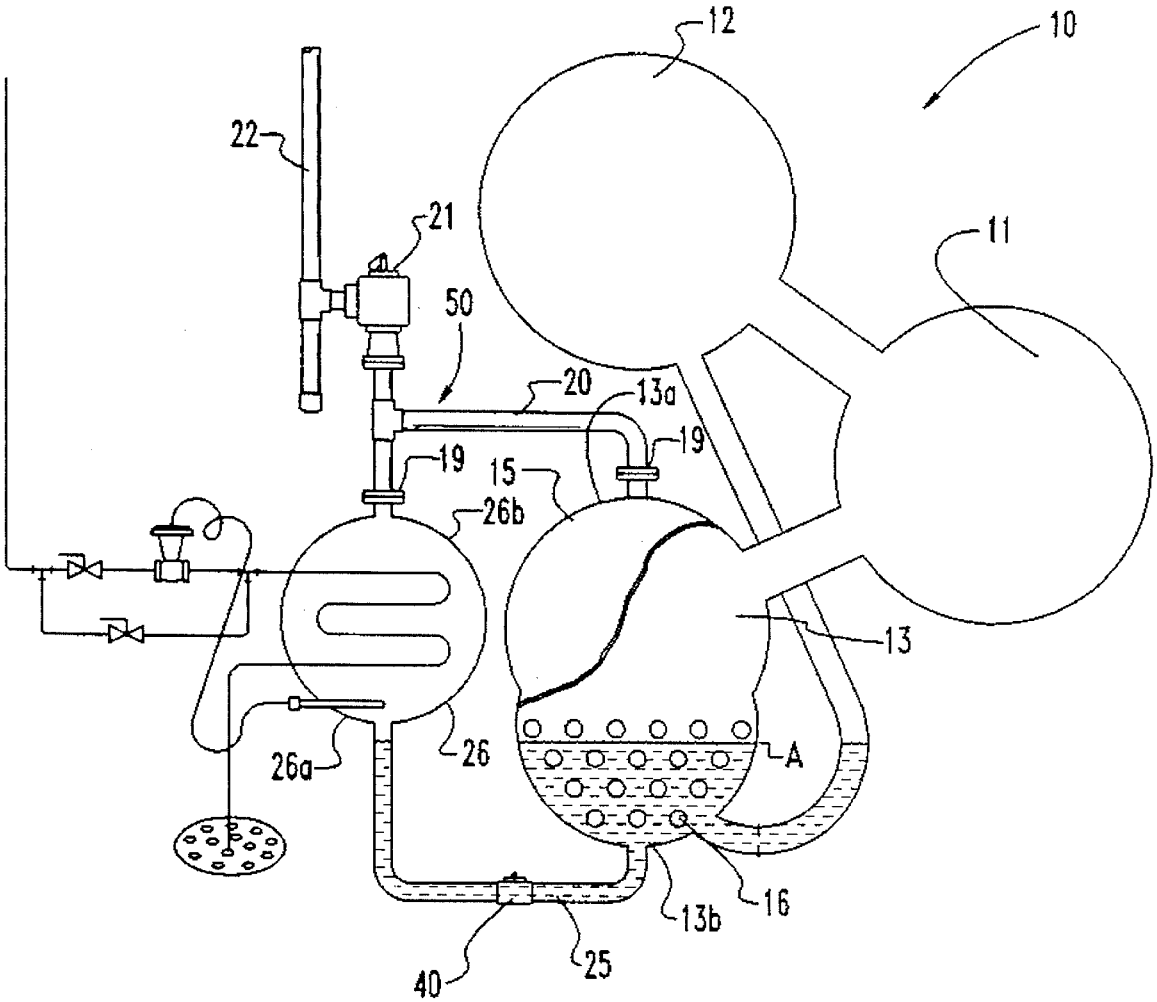
FIG. 1 is an illustrative side elevational view of one embodiment of the present invention in normal operation with the centrifugal chiller shut off.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a mechanical refrigeration system 10 which comprises a closed loop system having three primary components. In the preferred embodiment the refrigeration system 10 is a low pressure centrifugal chiller. The three components are a compressor 11, a Condenser 12 and an evaporator 13. In operation, a fluorocarbon refrigerant fluid flows through the closed loop system. Refrigerants which are usable in the present refrigeration system 10 include all man made refrigerants, such as FREON 12, R11, R113 or other CFC'S, HFC 134 and HCFC 123. It is well known to a person skilled in the art that the compressor 11 is utilized to compress the refrigerant fluid from a relatively low pressure gaseous state to a higher pressure gaseous state.

The relatively high pressure refrigerant gas upon exiting the compressor flows into the condenser 12, which functions as a heat exchanger. The condenser 12 removes energy from the vaporized refrigerant to facilitate the condensation of the relatively high pressure refrigerant vapor into a liquified refrigerant. The cooled liquid refrigerant then generally flows through an expansion device that reduces the pressure and regulates the flow of refrigerant fluid into evaporator 13.

The evaporator 13 is of a conventional shell and tube type, including a generally elongated cylindrical shell 15 having a plurality of tubes 16 passing therethrough. The tubes 16 have a heat exchange medium passing therethrough, such as brine, a water-glycol solution or water, that is intended to be cooled in the evaporator. The cooling of the heat exchange medium in tubes 16 occurs when the refrigerant fluid absorbs heat from the tubes 16, which occurs as the refrigerant fluid is vaporized into a low pressure refrigerant gas. The relatively low pressure refrigerant gas is then drawn through a suction line between the evaporator 13 and the compressor 11, where the above described cycle begins again.

In the preferred embodiment the evaporator 13 is designed and constructed to operate normally under a vacuum of about 16 inches of mercury, and the pressure within the evaporator shell 15 should not exceed 15 pounds per square inch gage. In order to comply with applicable safety codes and to protect the equipment a pressure relief system 50 is connected to evaporator 13 to allow the venting of refrigerant gas when the pressure therein exceeds 15 pounds per square inch gage. The pressure relief system 50 includes rupture disks 19 and a reseating pressure relief valve 21. One of the rupture disks 19 is disposed in fluid communication with the top side 13*a* of evaporator 13. In the preferred embodiment the rupture disk 19 is a metal non-fragmentary rupture disk which will burst upon exposure to a first predetermined pressure. In an alternative embodiment of the present invention the rupture disk 19 is a fragmentary carbon disk which fragments upon exposure to a first predetermined pressure. In the preferred embodiment the first predetermined pressure which causes the rupture disk 19 to burst is about 15 pounds per square inch gage. It is understood that rupture disks having different bursting pressure are contemplated herein. Further, the rupture disks 19 could be replaced by other devices that allow the venting of refrigerant fluid within the evaporator 13 when the pressure therein exceeds the first predetermined valve.

The reseating pressure relief valve 21 is connected with rupture disks 19 through a conduit 20. Reseating pressure relief valve 21 opens after exposure to the first predetermined pressure to allow the venting of refrigerant gas to the atmosphere, and closes after the pressure drops below this first predetermined pressure to stop further venting of refrigerant gas into the atmosphere. A vent pipe 22 is attached to the structure, and connects the pressure relief valve 21 in fluid communication with the atmosphere.

The fluid containment system is designed for minimizing or preventing the loss of refrigerant fluid and includes a conduit 25 which is connected between the bottom side 13*b* of the evaporator shell 15 and an over-pressure containment vessel 26. In the preferred embodiment the conduit 25 is connected to the bottom side of evaporater 13, however an alternative embodiment connects the conduit 25 to the substantial bottom side of evaporator 13. In the preferred embodiment the conduit 25 is a 2 inch diameter pipe that provides a sealed pathway for fluid flow between the evaporator 13 and the containment vessel 26, and is capable of handling the rapid transfer of fluid therebetween. The containment vessel 26 is a sealed vessel having conduit 25 connected to its bottom side 26*a*, and a rupture disk 19 connected to its top side 26*b*. The rupture disk 19 connected to containment vessel 26 functions as the previously described rupture disk 19 connected to evaporator 13.

Figure 3:
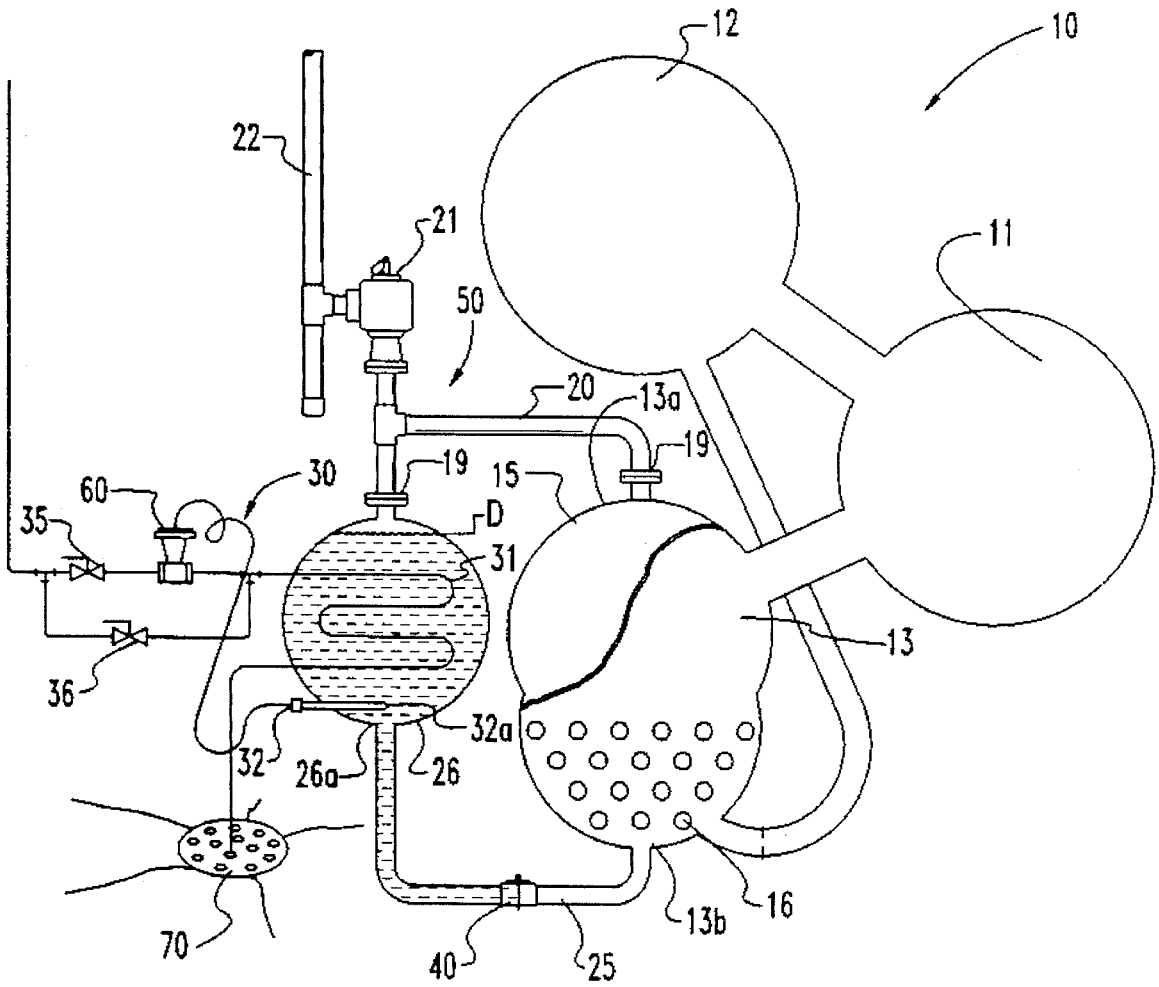
FIG. 3 is an illustrative side elevational view of the FIG. 1 invention in abnormal operation where the refrigerant fluid is stored in a containment vessel to allow the servicing and repair of the mechanical refrigeration system.

In a preferred embodiment the bottom side 26*a* of containment vessel 26 is positioned above the bottom side 13*a* of evaporator 13. In the most preferred embodiment containment vessel 26 is positioned relative to evaporator 13 such that the bottom side 26*a* of vessel 26 is located at or above the highest normal level (indicated at A) of liquid refrigerant in the non over pressure condition evaporator 13 in normal operation when the centrifugal chiller is shut down. It is meant that the term "normal operation" as used herein includes the operational states wherein the chiller 10 is shut down, and when it is running. While normal operation includes both operation in a normal pressure and an over-pressure condition it does not include the state where substantially all of the refrigerant fluid has been transferred from evaporator 13 and isolated in containment vessel 26 for the purpose of servicing, adding, removing or replacing a component within the mechanical refrigeration system 10 (FIG. 3). The mode of operation where substantially all of the refrigerant liquid is transferred to and contained within the containment vessel 26 is referred to herein as abnormal operation.

Figure 2:
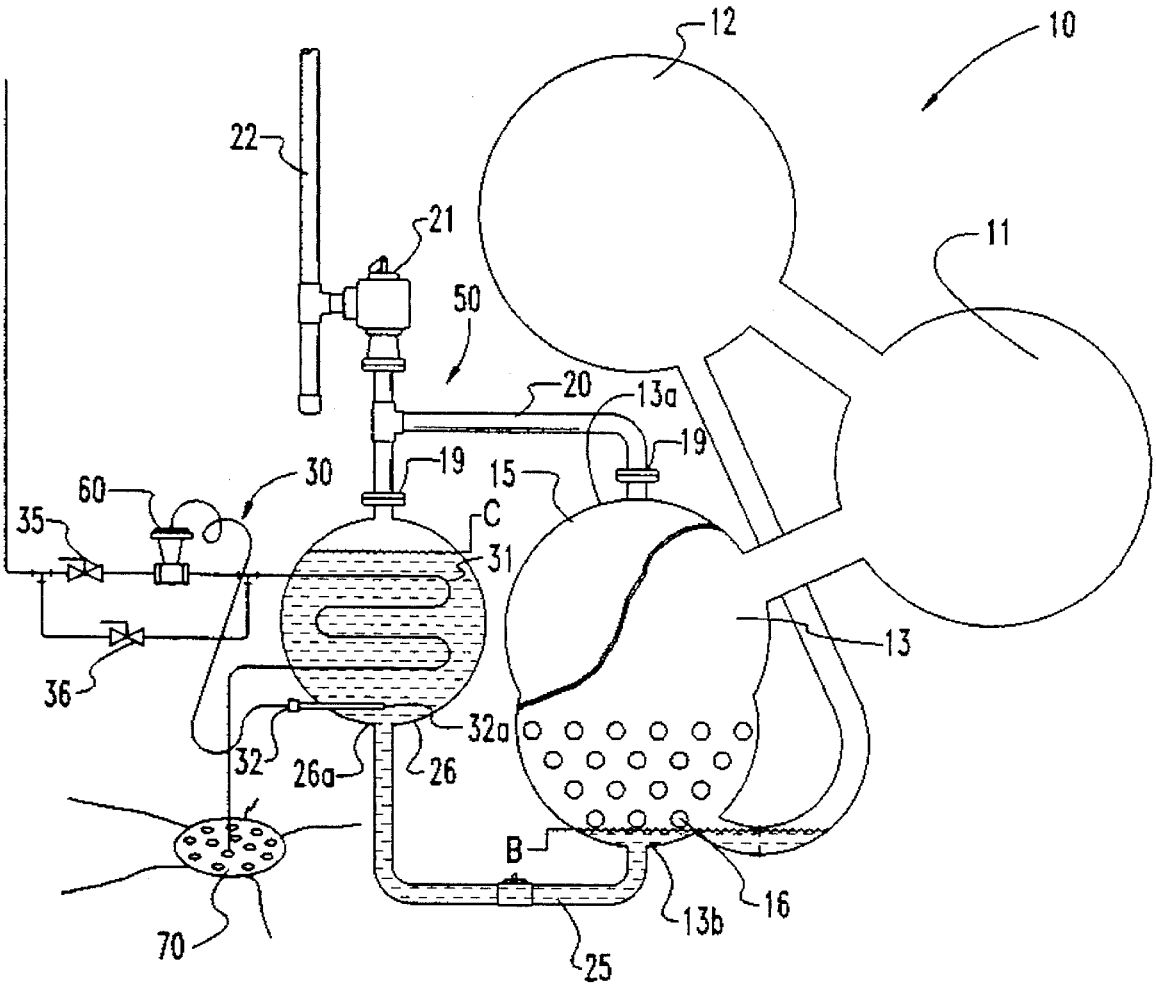
FIG. 2 is an illustrative side elevational view of the FIG. 1 invention, and a pressure buildup has occurred in the evaporator and caused a refrigerant fluid transfer.

During normal operation of the centrifugal chiller 10 there is an uninterrupted fluid communication pathway between containment vessel 26 and evaporator 13. There is a equilibrium state in the fluid containment system where the pressure and liquid refrigerant height in containment vessel 26 and evaporator 13 are equal and therefore there is no fluid flow therebetween. However, because of many factors, one being a temperature change within the evaporator 13 and/or containment vessel 26, a pressure differential can result between the containment vessel 26 and evaporator 13. This pressure differential between containment vessel 26 and evaporator 13 causes the flow of liquid refrigerant between the respective vessels. With reference to FIG. 2, there is illustrated an example where an increase in temperature occurs in evaporator 13 which in turn causes an increase in pressure within evaporator 13, which pressure is greater than the pressure in vessel 26, then liquid refrigerant would flow from evaporator 13 to containment vessel 26. The level of liquid refrigerant in the evaporator 13 being illustrated at B, while the level of liquid refrigerant in the containment vessel being illustrated at C. The movement of a quantity of liquid refrigerant from evaporator 13 to containment vessel 26 causes a decrease in pressure within evaporator 13.

Upon the correction of the cause of an over pressure condition in evaporator 13 the pressure in the evaporator 13 may equalize to or drop below the pressure in containment vessel 26, and therefore a pressure differential, gravity, or both will cause the flow of liquid refrigerant from containment vessel 26 to evaporator 13. The hi-directional flow of fluid between the evaporator 13 and containment vessel 26 is controlled by pressure differentials, and provides for the relieving of an over pressure condition in evaporator 13 and the return of refrigerant to the evaporator 13.

In the preferred embodiment an active open loop heat exchanger system 30 is connected with containment vessel 26 The heat exchanger system 30 includes a pathway for a quantity of cooling media to pass through in order to cool the refrigerant fluid within containment vessel 26. In the preferred embodiment pathway 31 defines a pipe positioned within containment vessel 26, however, an alternative embodiment of the present invention has pathway 31 positioned entirely outside of containment vessel 26. The cooling media receivable within pathway 31 is preferably water, that is supplied from a well, city service or other source capable of delivering the necessary quantity and fluid pressure. The cooling media flowing through pathway 31 absorbs energy from the refrigerant fluid within containment vessel 26. The cooling media exits the pathway 31 and is dispensed into a drain 70 or other ecologically sound system for disposing of the cooling media. It is understood that the cooling of the refrigerant fluid in vessel 26 could be accomplished by other methods.

In the preferred embodiment a temperature regulated valve 60 controls the flow of cooling media through pathway 31. A temperature sensing probe 32 is positioned in proximity with the refrigerant in vessel 26, and the temperature sensing probe 32 is connected to valve 60. In the preferred embodiment the tip 32*a* of probe 32 is positioned within the containment vessel 26 and is contactable with the refrigerant fluid. Upon probe 32 sensing that the temperature of the refrigerant fluid within containment vessel 26 has exceeded a second predetermined value the temperature regulated valve 60 will open to allow the flow of cooling media through pathway 31. In the preferred embodiment the second predetermined valve is 90° F. It is understood that the temperature at which the valve 60 opens to allow the flow of cooling media can be changed as required. One valve of this general type is manufactured by Jordan Valve of Cincinnati, Ohio and is sold as a Mark 80 model.

A flow control valve 35 is connected to the cooling media supply and controls the flow of cooling media to the temperature regulated valve 60. Another flow control valve 36 is plumbed in a parallel flow path with the temperature regulating valve 60 and is designed as a bypass for allowing the servicing and replacement of temperature regulating valve 60. Further, the closing of control valve 35 and the opening of control valve 36 allows the removal of the temperature regulating valve 60 without disrupting the flow of cooling media through conduit 31. Further, the closing of control valve 35 and opening of control vale 36 can be used to reduce the temperature of the refrigerant fluid in containment vessel 26 during an isolation procedure.

Mechanical refrigeration system 10 requires periodic maintenance or repair which may necessitate isolating the refrigerant fluid from the components to be serviced. With reference to FIG. 3, there is illustrated the mechanical refrigeration system 10 with the refrigerant fluid isolated (level indicated at D) in containment vessel 26. In order to facilitate the transfer of the refrigerant fluid from evaporator 13 to containment vessel 26 the cooling media is allowed to bypass the temperature regulating valve 60 and circulate relative to vessel 26 in order to lower its temperature. The cooling of the refrigerant fluid within the containment vessel 26 increases the pressure differential between vessel 26 and evaporator 13 which allows the entire or almost entire quantity of liquid refrigerant to flow into the containment vessel 26. Subsequently, the isolation valve 40 is closed and the refrigerant is prevented from returning to evaporator 13. In the preferred embodiment the containment vessel 26 is of sufficient size to contain the entire liquid refrigerant charge in system 10. Isolation valve 40 in the preferred embodiment is a manually operated valve.

Any remaining refrigerant in the mechanical refrigeration system 10 can be evacuated by using an evacuation system to transfer the remaining refrigerant to the containment vessel 26; systems and methods to evacuate refrigerant vapor are generally well known to persons skilled in the art. After completing the service of compressor 11, condenser 12, evaporator 13, or other parts in the mechanical refrigeration system the isolation valve 40 is opened to allow the return of refrigerant fluid into evaporator 13. Upon the completion of the servicing and the opening of the isolation valve 40 the mechanical refrigeration system is returned to normal operation.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A fluid containment system for minimizing or preventing the loss of refrigerant fluid, comprising:

a mechanical refrigeration system incorporating refrigerant fluid;

an evaporator within said refrigeration system, said evaporator for receiving said fluid therein; and an over pressure containment vessel in fluid communication with said evaporator, said vessel for receiving fluid from said evaporator to reduce the pressure in said evaporator and the receipt of fluid from said evaporator being controlled by a pressure differential between said evaporator and said vessel during normal operation of said mechanical refrigerant systems.

2. The fluid containment system of claim 1, wherein said over pressure containment vessel in fluid communication to the bottom side of said evaporator.

3. The fluid containment system of claim 2, wherein the bottom side of said containment vessel being located above the highest normal level of liquid refrigerant in said evaporator.

4. The fluid containment system of claim 3, wherein said refrigerant fluid from said containment vessel is receivable in said evaporator when the pressure in said evaporator is about equal to or less than than the pressure in said containment vessel during normal operation of said mechanical refrigeration system.

5. The fluid containment system of claim 4, which further includes a heat exchanger connected to said containment vessel, said heat exchanger for reducing the temperature of refrigerant fluid within said vessel.

6. The fluid containment system of claim 5, wherein said heat exchanger is an active system.

7. The fluid containment system of claim 6, wherein said heat exchanger having a pathway for the passing of a cooling media proximate said refrigerant fluid within said containment vessel.

8. The fluid containment system of claim 7, wherein said heat exchanger includes a valve for controlling the flow of said cooling media to said pathway.

9. The fluid containment system of claim 8, wherein the flow of said cooling media through said valve being controlled by the temperature of said refrigerant fluid in said containment vessel.

10. The fluid containment system of claim 9, wherein said valve being a temperature regulated valve.

11. The fluid containment system of claim 10, wherein said temperature regulated valve opens at about 90° F.

12. The fluid containment system of claim 11, which further includes an isolation valve, said isolation valve for preventing the flow of refrigerant fluid from said containment vessel to said evaporator when the mechanical refrigeration system is in abnormal operation.

13. The fluid containment system of claim 12, wherein said isolation valve is manually operated.

14. The fluid containment system of claim 13, wherein said mechanical refrigeration system is a centrifugal chiller.

15. The fluid containment system of claim 1, wherein said mechanical refrigeration system is a centrifugal chiller.

16. The fluid containment system of claim 1, wherein said refrigerant fluid from said containment vessel is receivable in said evaporator when the pressure in said evaporator is less than or equal to the pressure in said containment vessel during normal operation of said mechanical refrigeration system.

17. The fluid containment system of claim 1, wherein said containment vessel having sufficient volume to receive the entire refrigerant fluid from said mechanical refrigeration system.

18. A fluid containment system for minimizing or preventing the loss of refrigerant fluid, comprising:

a mechanical refrigeration system incorporating refrigerant fluid;

an evaporator within said refrigeration system, said evaporator for receiving said fluid therein;

an over pressure containment vessel in fluid communication with said evaporator, said vessel for receiving said fluid from said evaporator to reduce the pressure in said evaporator; and cooling means connected to said vessel for reducing the temperature of fluid in said vessel.

19. The fluid containment system of claim 18, wherein the bottom side of said containment vessel being located above the highest normal level of liquid refrigerant in said evaporator.

20. The fluid containment system of claim 19, wherein said cooling means defining a heat exchanger.

21. The fluid containment system of claim 20, wherein said heat exchanger incorporating a cooling media.

22. The fluid containment system of claim 21, wherein said cooling media is water.

23. The fluid containment system of claim 22, wherein said cooling media passes proximate said refrigerant fluid within said containment vessel.

24. The fluid containment system of claim 23, wherein said heat exchanger having a pathway therein for said cooling media.

25. The fluid containment system of claim 24, wherein said heat exchanger not being a closed system.

26. The fluid containment system of claim 25, wherein the flow of said cooling media through said pathway is controlled by the temperature of said refrigerant fluid in said containment vessel.

27. The fluid containment system of claim 26, wherein the flow of said cooling media through said pathway is controlled by a temperature regulated valve.

28. The fluid containment system of claim 27, which further includes an isolation valve, said isolation valve for preventing the flow of refrigerant fluid from said containment vessel to said evaporator when the mechanical refrigeration system is in abnormal operation.

* * * * *